US005746837A

United States Patent [19]

Beck et al.

[11] Patent Number: 5,746,837

[45] Date of Patent: May 5, 1998

[54] PROCESS FOR TREATING AN ALUMINUM CAN USING A MOBILITY ENHANCER

[75] Inventors: Leslie M. Beck, Concord; David A. Raney, Brookpark, both of Ohio

[73] Assignee: PPG Industries, Inc., Pittsburgh, Pa.

[21] Appl. No.: 786,407

[22] Filed: Jan. 21, 1997

Related U.S. Application Data

[60] Continuation of Ser. No. 447,891, May 23, 1995, abandoned, which is a division of Ser. No. 212,324, Mar. 14, 1994, abandoned, which is a continuation of Ser. No. 18,736, Feb. 17, 1993, abandoned, which is a continuation-in-part of Ser. No. 889,172, May 27, 1992, abandoned.

[51] Int. Cl.[6] ..... C23G 1/02

[52] U.S. Cl. ..... 134/2; 134/3; 134/25.1; 134/41

[58] Field of Search ..... 134/2, 3, 22.13, 134/22.17, 25.1, 27–29, 41; 252/117, 540

[56] References Cited

U.S. PATENT DOCUMENTS

| | | | |
|---|---|---|---|
| Re. 27,662 | 6/1973 | Hamilton | 252/79.4 |
| Re. 31,198 | 4/1983 | Binns | 134/3 |
| Re. 32,661 | 5/1988 | Binns | 252/142 |
| 3,313,729 | 4/1967 | Glasson | 252/18 |
| 3,635,826 | 1/1972 | Hamilton | 252/79.4 |
| 3,748,177 | 7/1973 | Neumann et al. | 134/30 |
| 3,969,134 | 7/1976 | Batka et al. | 134/26 |
| 3,969,135 | 7/1976 | King et al. | 134/41 |
| 4,009,115 | 2/1977 | Binns | 252/142 |
| 4,017,334 | 4/1977 | Matsushimi et al. | 148/6.15 R |
| 4,042,416 | 8/1977 | Miskech | 134/10 |
| 4,054,466 | 10/1977 | King et al. | 148/6.27 |
| 4,082,867 | 4/1978 | Henley et al. | 427/327 |
| 4,116,853 | 9/1978 | Binns | 252/142 |
| 4,124,407 | 11/1978 | Binns | 134/3 |
| 4,199,381 | 4/1980 | Nuss et al. | 148/6.15 R |
| 4,256,602 | 3/1981 | McLaughlin | 252/142 |
| 4,338,140 | 7/1982 | Reghi | 148/247 |
| 4,348,294 | 9/1982 | King | 252/142 |
| 4,370,173 | 1/1983 | Dollman | 134/3 |
| 4,435,223 | 3/1984 | Dollman | 134/3 |
| 4,435,297 | 3/1984 | Forsberg | 252/34.7 |
| 4,447,348 | 5/1984 | Forsberg | 252/75 |
| 4,448,703 | 5/1984 | Forsberg | 252/75 |
| 4,477,290 | 10/1984 | Carroll et al. . | |
| 4,540,444 | 9/1985 | Kelly | 134/3 |
| 4,599,116 | 7/1986 | King et al. | 134/2 |
| 4,647,314 | 3/1987 | Mullins et al. | 134/30 |
| 4,659,492 | 4/1987 | Jarode | 252/49.3 |
| 4,661,275 | 4/1987 | Forsberg | 252/49.3 |
| 4,664,834 | 5/1987 | Forsberg | 252/77 |
| 4,666,620 | 5/1987 | Forsberg | 252/49.3 X |
| 4,670,168 | 6/1987 | Laemmle et al. | 252/49.3 X |
| 4,708,753 | 11/1987 | Forsberg | 149/2 |
| 4,728,456 | 3/1988 | Yamisoc et al. | 252/142 |
| 4,749,500 | 6/1988 | Forsberg et al. | 252/49.3 |
| 4,762,638 | 8/1988 | Dollman et al. | 252/135 |
| 4,851,148 | 7/1989 | Yamisoc et al. | 252/142 |
| 4,859,351 | 8/1989 | Awad | 252/32.5 |
| 4,863,534 | 9/1989 | Forsberg | 149/2 |
| 4,876,019 | 10/1989 | Meyer et al. | 252/32.5 |
| 4,886,616 | 12/1989 | Yamisoc et al. | 252/142 |
| 4,919,178 | 4/1990 | Riga et al. | 149/2 |
| 4,944,889 | 7/1990 | Awad | 252/32.5 |
| 5,030,323 | 7/1991 | Awad | 156/665 |
| 5,043,382 | 8/1991 | Meyer et al. | 252/32.5 X |
| 5,061,389 | 10/1991 | Reichgott | 252/49.3 |
| 5,064,500 | 11/1991 | Awad | 156/665 |
| 5,080,814 | 1/1992 | Awad | 252/49.3 |
| 5,122,202 | 6/1992 | Dykskia et al. | 148/247 |
| 5,149,451 | 9/1992 | Tull | 252/49.3 |

FOREIGN PATENT DOCUMENTS

| | | |
|---|---|---|
| 1042263 | 9/1966 | United Kingdom . |
| 2187206 | 9/1987 | United Kingdom . |

OTHER PUBLICATIONS

Ferro Chemical Division, Product Literature for DI–43 (1980).

*Primary Examiner*—Lyle A. Alexander
*Attorney, Agent, or Firm*—Kenneth J. Stachel

[57] ABSTRACT

This invention relates to an aqueous composition for use in enhancing the mobility of an aluminum can that is transported along a conveyor or trackwork, said composition comprising water and a mobility enhancing amount of (A) the product made by the reaction of (A)(I) at least one carboxylic acid or acid-producing compound with (A)(II) ammonia, at least one amine, or at least one alkali or alkaline-earth metal. This invention also relates to a process for cleaning an aluminum can wherein the foregoing mobility enhancer is applied to the exterior of an aluminum can during the wash stage, during a conditioning or conversion coating stage, or during one or more rinse stages. The aqueous compositions of the invention containing alkanolamide mobility enhancers also reduce the temperature at which washed cans can be dried.

17 Claims, No Drawings

PROCESS FOR TREATING AN ALUMINUM CAN USING A MOBILITY ENHANCER

CROSS-REFERENCE TO RELATED APPLICATION

This application is a continuation of application Ser. No. 08/447,891 filed on May 23, 1995, now abandoned, which is a divisional application of Ser. No. 08/212,324 filed on Mar. 14, 1994, now abandoned, which is a continuation of Ser. No. 08/018,736 filed on Feb. 17, 1993, now abandoned, which is a continuation-in-part of Ser. No. 07/889,172 filed on May 27, 1992, now abandoned. The specification and claims of this earlier filed pending application are hereby incorporated in this application.

BACKGROUND OF THE INVENTION

1. Field of the Invention

This invention relates to compositions and processes for improving the mobility of aluminum cans as they are conveyed along a conveyor or trackwork and for lowering the temperature at which washed cans dry. The invention is particularly suitable for improving the mobility of aluminum cans that are washed subsequent to their formation, the improved mobility enhancing the movement of the cans as they are conveyed at high speeds from the wash process areas of the manufacturing facility to other areas for further processing (e.g., painting, lacquering, etc.).

2. Discussion of Related Art

Aluminum cans are commonly used as containers for a wide variety of products. After their manufacture, the aluminum cans are typically washed with acidic or alkaline cleaners to remove aluminum fines and other contaminants therefrom. A clean and stain-free aluminum surface is desirable in order to ensure the proper application of paints and inks. It also is desirable that the aluminum cans be conveyed smoothly through the manufacturing process. The term "mobility" is used in the industry to refer to the ability of an aluminum can to travel smoothly through the manufacturing process conducted at the highest speed possible. Improved mobility allows for increases in production and increased profits.

However, thoroughly cleaned aluminum cans by either acid or alkaline cleaner are, in general, characterized by high-surface roughness and thus have a high coefficient of static friction. This property hinders the mobility of cans through single filers and printers when attempting to increase their line speed. If the containers are not characterized by an acceptable mobility, the flow of cans through the printers and single filers is affected which often results in frequent jammings, downtime, printer misfeeding problems, loss of production and high rate of can rejects.

Thus, a need has arisen in the aluminum can manufacturing industry to modify the coefficient of static friction on the outside surface of the cans to improve their mobility without adversely affecting the application of paints or inks. The reason for improving the mobility of aluminum cans is the general trend in this manufacturing industry to increase production without additional capital investments in building new plants. The increased production demand is requiring can manufactures to increase their line and printer speeds to produce more cans per unit of time.

U.S. Pat. No. 4,599,116 describes an alkaline cleaning process for aluminum container surfaces. The aqueous alkaline cleaning composition contains an alkalinity agent, a complexing agent to chelate at least some of the metal ions removed from the metal surface by the cleaning solution, and at least one surfactant to remove organic soils from the surfaces of the container and to inhibit white-etch staining of the surfaces. The reference indicates that following cleaning a conversion coating can be applied to the surface of the can and the application of this conversion coating enhances the mobility of the cans as they are conveyed through trackwork.

U.S. Pat. Nos. 4,859,351; 4,944,889; 5,030,323; 5,064,500; and 5,080,814 describe lubricant and surface conditioners for application to aluminum cans. These patents indicate that the disclosed compositions reduce the coefficient of static friction on the outside surface of the cans which enhances mobility and thereby permits an increase in production line speed. The lubricant and surface conditioners disclosed in these patents are water-soluble alkoxylated surfactants, namely, organic phosphate esters; alcohols; fatty acids including mono-, di-, tri-, and poly-acids; fatty acid derivatives such as salts, hydroxy acids, amides, esters, ethers and derivatives thereof; and mixtures thereof. The references state that the lubricant and surface conditioner may be applied to the cans during the wash cycle, during one of the treatment cycles, during one of the rinse cycles, or after the final water rinse. Both acidic and alkaline wash cycles are disclosed.

U.S. Pat. No. 5,061,389 discloses a composition and process for reducing the coefficient of friction on the surface of formed metal structures, such as aluminum cans, by lubricating the surface with a blend of a polyethylene glycol ester with a fluoride compound.

SUMMARY OF THE INVENTION

This invention relates to an aqueous composition for use in enhancing the mobility of an aluminum can that is transported along a conveyor or trackwork, said composition comprising water and a mobility enhancing amount of (A) the product made by the reaction of (A)(I) at least one carboxylic acid or acid-producing compound with (A) (II) ammonia, at least one amine, or at least one alkali or alkaline-earth metal. This invention also relates to a process for cleaning an aluminum can wherein the foregoing mobility enhancer is applied to the exterior of an aluminum can during the wash stage, during a conditioning or conversion coating stage, or during one or more rinse stages. The aqueous compositions of the invention containing alkanolamide mobility enhancers also reduce the temperature at which washed cans can be dried.

DESCRIPTION OF THE PREFERRED EMBODIMENTS

The term "hydrocarbyl" is used herein to include:

(1) hydrocarbyl groups, that is, aliphatic (e.g., alkyl or alkenyl), alicyclic (e.g., cycloalkyl, cycloalkenyl), aromatic, aliphatic- and alicyclic- substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three nonhydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation; ethylenic unsaturation, when present will generally be such that there is no more than one ethylenic linkage present for every ten carbon- to-carbon bonds. The hydrocarbyl groups are often completely saturated and therefore contain no ethylenic unsaturation.

The term "lower" as used herein in conjunction with terms such as alkyl, alkenyl, alkoxy, and the like, is intended to describe such groups which contain a total of up to 7 carbon atoms.

Mobility Enhancer (A)

The inventive mobility enhancer is the product (A) made by the reaction of (A)(I) at least one carboxylic acid or acid-producing compound with (A)(II) ammonia, at least one amine, or at least one alkali or alkaline-earth metal. These products, when applied to the exterior surface of an aluminum can, are useful in enhancing the mobility of the can as it is conveyed at high speeds along a conveyor in manufacturing processes. In one embodiment of the invention, these products are applied to the can surface during one or more washing or rinsing steps that are used following can formation.

The Carboxylic Acid or Acid-Producing Compound (A)(I)

The carboxylic acid (A)(I) is any carboxylic acid capable of reacting with component (A)(II) to provide the desired mobility enhancer (A). The acid-producing compounds (A)(I) are anhydrides, acid halides and esters of the foregoing acids.

In one embodiment, the carboxylic acid (A)(I) is at least one fatty acid. These acids are derived from or contained in animal or vegetable fat or oil. (Liquid fats are often referred to as oils.) They are composed of a hydrocarbon chain of 1 to about 30 carbon atoms, preferably about 4 to about 26 carbon atoms, more preferably about 12 to about 22 carbon atoms, and are characterized by a terminal—COOH group. They may be saturated or unsaturated, and are typically solids, semisolids or liquids. Examples of the saturated fatty acids include butyric, lauric, octanoic, palmitic, myristic, stearic, isostearic, and behenic. Examples of unsaturated acids include oleic, linoleic and linolenic. Sources of these fatty acids include beef tallow, butter, coconut oil, corn oil, cottonseed oil, lard, olive oil, palm oil, palm kernel, peanut oil, soybean oil, cod liver oil, linseed oil, tung oil, fish oil, tall oil and rosin.

In one embodiment component (A)(I) is at least one mono-, di- or triglyceride represented by the formula

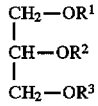

wherein $R^1$, $R^2$ and $R^3$ are independently hydrogen or acyl groups represented by the formula

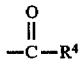

wherein $R^4$ is a hydrocarbyl group of about 1 to about 30 carbon atoms, with the proviso that at least one of $R^1$, $R^2$ or $R^3$ is said acyl group. $R^4$ preferably has about 3 to about 30 carbon atoms, more preferably about 8 to about 30 carbon atoms, more preferably about 8 to about 26 carbon atoms, more preferably about 12 to about 20 carbon atoms. $R^4$ is preferably a straight chain hydrocarbon that can be saturated or unsaturated. The unsaturated groups can contain one or more double bonds.

Representative

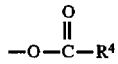

moieties are listed in Table A below

TABLE A

| Number of Carbons | Number of Double Bonds | Common Name | Systematic Name | Formula |
|---|---|---|---|---|
| 12 | 0 | Lauryl | n-Dodecanoate | $CH_3(CH_2)_{10}COO^-$ |
| 14 | 0 | Myristyl | n-Tetradecanoate | $CH_3(CH_2)_{12}COO^-$ |
| 16 | 0 | Palmityl | n-Hexadecanoate | $CH_3(CH_2)_{14}COO^-$ |
| 18 | 0 | Stearyl | n-Octadecanoate | $CH_3(CH_2)_{18}COO^-$ |
| 20 | 0 | Arachidyl | n-Eicosanoate | $CH_3(CH_2)_{18}COO^-$ |
| 16 | 1 | Palmitoleyl | cis-$\Delta^9$-Hexadecenoate | $CH_3(CH_2)_6CH{=}CH(CH_2)_7COO^-$ |
| 18 | 1 | Oleyl | cis-$\Delta^9$-Octadecenoate | $CH_3(CH_2)_7CH{=}CH(CH_2)_7COO^-$ |

These glycerides are esters that occur naturally in animal and vegetable fats and oils. Examples of such fats and oils include corn oil, coconut oil, soybean oil, cottonseed oil, palm oil, tallow, bacon grease, butter, castor oil, tall oil and rosin. Examples of useful glycerides include glycerol 1,3-distearate, glycerol monolaurate, glycerol monooleate, glycerol monoricinoleate, glycerol monostearate, glycerol tributyrate, glycerol tripropionate, glycerol tristearate, glyceryl trioleate, glyceryl tripalmitate, and glyceryl triricinoleate.

The acid or acid-producing compounds (A)(I) include polycarboxylic acids, preferably di- and tricarboxylic acids. These polycarboxylic acids preferably have up to about 30 carbon atoms, more preferably about 4 to about 30 carbon atoms, more preferably about 8 to about 30 carbon atoms. These include maleic acid, chloromaleic acid, succinic acid, glutaric acid, adipic acid, pimelic acid, azelaic acid, sebacic acid, glutaconic acid, citraconic acid, itaconic acid, allyl succinic acid, tartaric acid, citric acid, malic acid, dodecanedioic acid, phthalic acid, isophthalic acid, terephthalic acid, trimellitic acid, and tetrapropylene-substituted succinic acid. Anhydrides as well as lower alkyl esters of these acids can also be used.

Hydrocarbyl-substituted succinic acid and anhydrides can be used. These succinic acids and anhydrides can be represented by the formulae

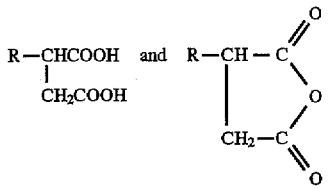

wherein R is a hydrocarbyl group of 1 to about 30 carbon atoms, preferably about 6 to about 24 carbon atoms. Preferably, R is an aliphatic or alicyclic hydrocarbyl group with less than about 10% of its carbon-to-carbon bonds being unsaturated. R can be derived from olefins of from 2 to about 18 carbon atoms with alpha-olefins being particularly useful. Examples of such olefins include ethylene, propylene, 1-butene, isobutene, 1-pentene, 2-methyl-1-butene, 3-methyl-1-butene, 1-hexene, 1-heptene, 1-octene, styrene, 1-nonene, 1-decene, 1-undecene, 1-dodecene, 1-tridecene, 1-tetradecene, 1-pentadecene, 1-hexadecene, 1-heptadecene, 1-octadecene, etc. Commercially available alpha olefin fractions such as $C_{15-18}$alpha-olefins, $C_{12-16}$alpha-olefins, $C_{14-16}$alpha-olefins, $C_{14-18}$alpha-olefins, $C_{16-18}$alpha-olefins, etc., are particularly useful; these commercial alpha-olefin fractions also usually include minor amounts of alpha-olefins outside the given ranges. The production of such substituted succinic acids and their derivatives is well known to those of skill in the art and need not be discussed in detail herein.

Acid halides of the afore-described carboxylic acids can be used. These can be prepared by the reaction of such acids or their anhydrides with halogenating agents such as phosphorus tribromide, phosphorus pentachloride, phosphorus oxychloride or thionyl chloride. Esters of such acids can be prepared simply by the reaction of the acid, acid halide or anhydride with an alcohol or phenolic compound. Particularly useful are the lower alkyl and alkenyl alcohols such as methanol, ethanol, allyl alcohol, propanol, cyclohexanol, etc. Esterification reactions are usually promoted by the use of alkaline catalysts such as sodium hydroxide or alkoxide, or an acidic catalyst such as sulfuric acid or toluene sulfonic acid.

Although it is preferred that the acid or acid-producing compound is an aliphatic carboxylic acid, component (A)(I) may also be an aromatic carboxylic acid or acid-producing compound. The aromatic acids are preferably carboxy-substituted benzene, naphthalene, anthracene, phenanthrene or like aromatic hydrocarbons. They include also the alkyl-substituted derivatives, and the alkyl groups may contain up to about 12 carbon atoms. The aromatic acid may also contain other substituents such as halo, hydroxy, lower alkoxy, etc. Specific examples of aromatic carboxylic acids and acid-producing compounds include phthalic acid, isophthalic acid, terephthalic acid, 4-methyl-benzene-1,3-dicarboxylic acid, naphthalene-1,4-dicarboxylic acid, anthracene dicarboxylic acid, 3-dodecyl-benzene-1,4-dicarboxylic acid, 2,5-dibutylbenzene-1,4-dicarboxylic acid, etc. The anhydrides of these carboxylic acids also are useful.

The Amines (A)(II)

The amines (A)(II) useful in making the inventive mobility enhancers include primary amines and secondary amines. These amines are characterized by the presence within their structure of at least one H—N< group and/or at least one —$NH_2$ group. These amines can be monoamines or polyamines. Mixtures of two or more amines can be used.

The amines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated. If unsaturated, the amine is preferably free from acetylenic unsaturation. The amines may also contain non-hydrocarbon substituents or groups as long as these groups do not significantly interfere with the reaction of the amines with the carboxylic acids or acid-producing compounds (A)(I). Such non-hydrocarbon substituents or groups include lower alkoxy, lower alkyl, mercapto, nitro, and interrupting groups such as —O— and —S— (e.g., as in such groups as —$CH_2CH_2$—X—$CH_2CH_2$— where X is —O— or —S—).

With the exception of the branched polyalkylene polyamines, the polyoxyalkylene polyamines and the high molecular weight hydrocarbyl-substituted amines described more fully hereinafter, the amines used in this invention ordinarily contain less than about 40 carbon atoms in total and usually not more than about 20 carbon atoms in total.

Aliphatic monoamines include mono-aliphatic and di-aliphatic-substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent, and the like. The total number of carbon atoms in these aliphatic monoamines preferably does not exceed about 40 and usually does not exceed about 20 carbon atoms. Specific examples of such monoamines include ethylamine, di-ethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenylethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamines, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines and pyranyl-substituted cyclohexylamine.

Suitable aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthylene. Examples of aromatic monoamines include aniline, di(paramethylphenyl) amine, naphthylamine, N-(n-butyl) aniline, and the like. Examples of aliphatic-substituted, cycloaliphatic-substituted, and heterocyclic-substituted aromatic monoamines include. para-ethoxyaniline, paradodecylamine, cyclohexyl-substituted naphthylamine and thienyl-substituted aniline.

Suitable polyamines include aliphatic, cycloaliphatic and aromatic polyamines analogous to the above-described monoamines except for the presence within their structure of another amino nitrogen. The other amino nitrogen can be a primary, secondary or tertiary amino nitrogen. Examples of such polyamines include N-aminopropyl-cyclohexylamine, N-N'-di-n-butyl- para-phenylenediamine, bis-(para-aminophenyl)-methane, 1,4-diaminocyclohexane, and the like.

Heterocyclic mono- and polyamines can also be used. As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen heteroatom. The 5- and 6-membered heterocyclic rings are preferred.

Among the suitable heterocyclics are aziridines, azetidines, azolidines, tetra- and di-hydro pyridines, pyrroles, indoles, piperadines, imidazoles, di- and tetra-hydroimidazoles, piperazines, isoindoles, purines, morpholines, thiomorpholines, N-aminoalkyl-morpholines, N-aminoalkylthio-morpholines N-aminoalkyl-piperazines, N,N'-di-aminoalkyl-piperazines, azepines, azocines, azonines, azecines and tetra-, di- and perhydro-derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are useful. Usually the aminoalkyl substituents are substituted on a nitrogen atom forming part of the hetero ring. Specific examples of such heterocyclic amines include N-aminopropylmorpholine, N-aminoethyl-piperazine, and N,N'-di-aminoethyl-piperazine.

Hydrazine and substituted-hydrazine can also be used as amines in this invention. At least one of the nitrogens in the hydrazine must contain a hydrogen directly bonded thereto. The substituents which may be present on the hydrazine include alkyl, alkenyl, aryl, aralkyl, alkaryl, and the like. Usually, the substituents are alkyl, especially lower alkyl, phenyl, and substituted phenyl such as loweralkoxy-substituted phenyl or lower alkyl-substituted phenyl. Specific examples of substituted hydrazines are methylhydrazine, N,N-dimethylhydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(paranitrophenyl)-N-methylhydrazine, N,N'-di-(para-chlorophenol)-hydrazine, N-phenyl-N'-cyclohexylhydrazine, and the like.

The high molecular weight hydrocarbyl amines, both monoamines and polyamines, which can be used as amines in this invention are generally prepared by reacting a chlorinated polyolefin having a molecular weight of at least about 400 with ammonia or an amine. The amines that can be used are known in the art and described, for example, in U.S. Pat. Nos. 3,275,554 and 3,438,757, both of which are incorporated herein by reference. These amines must possess at least one primary or secondary amino group.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene $$\text{(i.e., } NH_2-R-\overset{\overset{\displaystyle H}{|}}{N}-R_x-\text{)}$$

group per nine amino units present on the main chain; for example, 1–4 of such branched chains per nine units on the main chain, but preferably one side chain unit per nine main chain units. Thus, these polyamines contain at least three primary amino groups and at least one tertiary amino group.

Suitable amines also include polyoxyalkylene polyamines, e.g., polyoxyalkylene diamines and polyoxyalkylene triamines, having average molecular weights ranging from about 200 to about 4000. Examples of these polyoxyalkylene polyamines include those amines represented by the formula:

$$NH_2\text{-Alkylene-}(\text{—O-Alkylene-})_m NH_2$$

wherein m has a value of from about 3 to about 70; and the formula:

$$R\text{—}[\text{Alkylene-}(\text{—O-Alkylene-})_n NH_2]_{3-6}$$

wherein n is a number in the range of from 1 to about 40, with the proviso that the sum of all of the n's is from about 3 to about 70, and R is a polyvalent saturated hydrocarbyl group of up to about 10 carbon atoms having a valence of from about 3 to about 6. The alkylene groups may be straight or branched chains and contain from 1 to about 7 carbon atoms, and usually from 1 to about 4 carbon atoms. The various alkylene groups present within the above formulae may be the same or different.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine". U.S. Pat. Nos. 3,804,763 and 3,948,800 are incorporated herein by reference for their disclosure of such polyoxyalkylene polyamines.

Useful amines are the alkylene polyamines, including the polyalkylene polyamines, as described in more detail hereafter. The alkylene polyamines include those conforming to the formula:

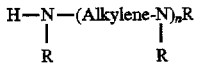

wherein n is from 1 to about 10; each R is independently a hydrogen atom, a hydrocarbyl group or a hydroxy-substituted hydrocarbyl group having up to about 100 carbon atoms, preferably up to about 50 carbon atoms, more preferably up to about 30 carbon atoms; and the "Alkylene" group has from 1 to about 18 carbon atoms, preferably 2 to about 18 carbon atoms, with the especially preferred alkylene being ethylene or propylene. Useful are the alkylene polyamines wherein each R is hydrogen with the ethylene polyamines, and mixtures of ethylene polyamines being particularly preferred. Usually n will have an average value of from about 2 to about 7. Such alkylene polyamines include methylene polyamines, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines that are useful include ethylene diamine, triethylene tetramine, propylene diamine, trimethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene) triamine, N-(2-aminoethyl) piperazine, 1,4-bis(2-aminoethyl) piperazine, and the like. Higher homologs as are obtained by condensing two or more of the above-illustrated alkylene amines are useful as amines in this invention as are mixtures of two or more of any of the afore-described polyamines.

Ethylene polyamines, such as those mentioned above, are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, these pages being incorporated herein by reference. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines.

Hydroxyamines both mono- and polyamines, analogous to those described above are also useful provided they contain at least one primary or secondary amino group. The hydroxy-substituted amines are typically those having hydroxy substituents bonded directly to a carbon atom other than a carbonyl carbon atom. Examples of such hydroxy-substituted amines include ethanolamine, di(3-hydroxypropyl)-amine, 3-hydroxybutylamine, 4-hydroxybutylamine, diethanolamine, di(2-hydroxypropyl) amine, N-hydroxypropyl propylamine, N-(2-hydroxyethyl) -cyclohexylamine,3-hydroxycyclopentylamine,para-hydroxyaniline,N-hydroxyethyl piperazine, and the like.

Typically, the hydroxyamines are primary or secondary alkanol amines or mixtures thereof. Such amines can be represented, respectfully, by the formulae:

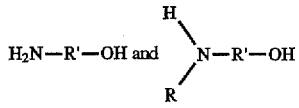

wherein each R is independently a hydrocarbyl group of one to about eight carbon atoms or hydroxyl-substituted hydrocarbyl group of two to about eight carbon atoms and R' is a divalent hydrocarbyl group of about two to about 18 carbon atoms. The group —R'—OH in such formulae represents the hydroxyl-substituted hydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is a lower alkyl group of up to seven carbon atoms.

The hydroxyamines can also be ether N-(hydroxy-substituted hydrocarbyl)amines. These are hydroxyl-substituted poly(hydrocarbyloxy) analogs of the above-described hydroxy amines (these analogs also include hydroxyl-substituted oxyalkylene analogs). Such N-(hydroxyl-substituted hydrocarbyl) amines can be conveniently prepared by reaction of epoxides with afore-described amines and can be represented by the formulae:

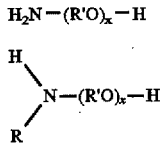

wherein x is a number from about 2 to about 15 and R and R' are as described above.

Polyamine analogs of these hydroxy amines, including alkoxylated alkylene polyamines (e.g., N,N-(diethanol)-ethylene diamine) can also be used. Such polyamines can be made by reacting alkylene amines (e.g., ethylenediamine) with one or more alkylene oxides (e.g., ethylene oxide, octadecene oxide) of two to about 20 carbons. Similar alkylene oxide-alkanol amine reaction products can also be used such as the products made by reacting the afore-described primary, secondary or tertiary alkanol amines with ethylene, propylene or higher epoxides in a 1:1 or 1:2 molar ratio. Reactant ratios and temperatures for carrying out such reactions are known to those skilled in the art.

Specific examples of alkoxylated alkylene polyamines include N-(2-hydroxyethyl) ethylene diamine, N,N-bis(2-hydroxyethyl)-ethylene-diamine, 1-(2-hydroxyethyl) piperazine, mono(hydroxypropyl)-substituted diethylene triamine, di(hydroxypropyl)-substituted tetraethylenepentamine, N-(3-hydroxybutyl)-tetramethylene diamine, etc. Higher homologs obtained by condensation of the above-illustrated hydroxy alkylene polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid mono- or polyamines are also useful.

Examples of the N-(hydroxyl-substituted hydrocarbyl) amines include mono-, di-, and triethanolamine, dimethylethanolamine, diethylethanolamine, di-(3-hydroxylpropyl) amine, N-(3-hydroxylbutyl)amine, N-(4-hydroxylbutyl)amine, N,N-di-(2-hydroxylpropyl) amine, N-(2-hydroxylethyl) morpholine and its thio analog, N-(2-hydroxylethyl) cyclohexylamine, N-3-hydroxyl cyclopentylamine, o-, m- and p-aminophenol, N-(hydroxylethyl) piperazine, N,N'-di(hydroxylethyl) piperazine, and the like.

Further hydroxyamines are the hydroxy-substituted primary amines described in U.S. Pat. No. 3,576,743 by the general formula $$R_a—NH_2$$

wherein $R_a$ is a monovalent organic group containing at least one alcoholic hydroxy group. The total number of carbon atoms in $R_a$ preferably does not exceed about 20. Hydroxy-substituted aliphatic primary amines containing a total of up to about 10 carbon atoms are useful. The polyhydroxy-substituted alkanol primary amines wherein there is only one amino group present (i.e., a primary amino group) having one alkyl substituent containing up to about 10 carbon atoms and up to about 6 hydroxyl groups are useful. These alkanol primary amines correspond to $R_a—NH_2$ wherein $R_a$ is a mono-O or polyhydroxy-substituted alkyl group. It is desirable that at least one of the hydroxyl groups be a primary alcoholic hydroxyl group. Specific examples of the hydroxy-substituted primary amines include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propanediol, 2-amino-2-ethyl-1,3-propanediol, N-(beta-hydroxypropyl)-N'-(beta-aminoethyl)-piperazine, tris-(hydroxymethyl) amino methane (also known as trismethylolamino methane), 2-amino-1-butanol, anol, ethanolamine, beta-(beta-hydroxyethoxy)-ethylamine, glucamine, glusoamine, 4-amino-3-hydroxy-3-methyl-1-butene (which can be prepared according to procedures known in the art by reacting isopreneoxide with ammonia), N-3(aminopropyl)-4-(2-hydroxyethyl)-piperadine, 2-amino-6-methyl-6-heptanol, 5-amino-1-pentanol, N-(beta-hydroxyethyl)-1,3-diamino propane, 1,3-diamino-2-hydroxypropane, N-(beta-hydroxyethoxyethyl)-ethylenediamine, trismethylolaminomethane and the like. U.S. Pat. No. 3,576,743 is incorporated herein by reference.

Hydroxyalkyl alkylene polyamines having one or more hydroxyalkyl substituents on the nitrogen atoms, are also useful. Useful hydroxyalkyl-substituted alkylene polyamines include those in which the hydroxyalkyl group is a lower hydroxyalkyl group, i.e., having less than eight carbon atoms. Examples of such hydroxyalkyl-substituted polyamines include N-(2-hydroxyethyl) ethylene diamine, N,N-bis(2-hydroxyethyl) ethylene diamine, 1-(2-hydroxyethyl)-piperazine, monohydroxypropyl-substituted diethylenetriamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

The Alkali and Alkaline Earth Metals (A)(II)

The alkali and alkaline earth metals that are useful as component (A)(II) can be any alkali or alkaline earth metal. The alkali metals are preferred. Lithium, sodium and potassium are useful. Calcium and magnesium are useful. Suitable metal bases for reaction with the carboxylic acid or acid-producing compound (A)(I) include the free metals as well as reactive compounds of such metals. The reactive compounds include nitrates, nitrites, halides, carboxylates, phosphates, phosphites, sulfates, sulfites, carbonates, oxides, hydroxides, acetates, etc. Examples of such reactive compounds include sodium oxide, sodium hydroxide, sodium carbonate, sodium methylate, sodium propylate, sodium pentylate, sodium phenoxide, potassium oxide, potassium hydroxide, potassium carbonate, potassium methylate, potassium pentylate, potassium phenoxide, lithium oxide, lithium hydroxide, lithium carbonate, lithium pentylate, calcium oxide, calcium hydroxide, calcium carbonate, calcium methylate, calcium ethylate, calcium propylate, calcium chloride, calcium fluoride, calcium pentylate, calcium phenoxide, calcium nitrate, barium oxide, barium hydroxide, barium carbonate, barium chloride, barium fluoride, barium methylate, barium propylate, barium pentylate, barium nitrate, magnesium oxide, magnesium hydroxide, magnesium carbonate, magnesium ethylate, magnesium propylate, magnesium chloride, magnesium bromide, barium iodide, magnesium phenoxide, etc. The above metal compounds are merely illustrative of those useful in this invention and the invention is not to be considered as limited to such.

Preparation of the Mobility Enhancer (A)

To prepare the inventive mobility enhancer, one or more of (A)(I) the acid or acid-producing compound and one or more of (A)(II) ammonia, amine, or alkali or alkaline earth metal, are mixed together and heated, optionally in the presence of a normally liquid, substantially inert organic liquid solvent/diluent, at temperatures of about 20° C. up to the decomposition temperature of the reaction component and/or product having the lowest such temperature. This temperature can be in the range of about 30° C. to about 300° C. Component (A)(I) and component (A)(II) are preferably reacted in amounts sufficient to provide from about 0.1 to about 3, preferably about 0.5 to about 2 equivalents of component (A)(II) per equivalent of component (A)(I).

For purposes of this reaction, an equivalent of the acid or acid-producing compound (A)(I) is its molecular weight divided by the total number of carboxylic functions (e.g., carboxylic acid groups, carboxylic anhydride groups) present in the acid or acid-producing compound. Thus, the equivalent weight of the acid or acid-producing compound will vary with the number of carboxy groups present therein. In determining the equivalent weight of the acid or acid-producing compound, those carboxyl functions which are not capable of reacting with component (A)(II) are excluded. For example, there would be two equivalents in one mole of maleic acid or maleic anhydride. Conventional techniques are readily available for determining the number of carboxyl functions (e.g., acid number, saponification number) and, thus, the number of equivalents of the acid or acid-producing compound (A)(I) available to react with component (A)(II) can be readily determined by one skilled in the art.

When component (A)(II) is an amine, an equivalent thereof is its molecular weight divided by the total number of primary and secondary amino nitrogens present in the molecule. Thus, octylamine has an equivalent weight equal to its molecular weight; ethylene diamine has an equivalent weight equal to one-half of its molecular weight; and ethanolamine has an equivalent weight equal to its molecular weight. The equivalent weight of a commercially available mixture of polyalkylene polyamines can be determined by dividing the atomic weight of nitrogen (14) by the percent N contained in the polyamine; thus, a polyalkylene polyamine mixture having a percent N of 34 would have an equivalent weight of 41.2.

When component (A)(II) is ammonia, an equivalent weight thereof is its molecular weight. When component (A)(II) is an alkali or alkaline earth metal, an equivalent weight thereof is its atomic weight divided by its valence.

When component (A)(II) is ammonia or an amine, the product made by the reaction of component (A)(I) with component (A)(II) can be an amide, imide or amine salt, and is typically a mixture of two or more of these. When component (A)(II) is a hydroxyamine, the product can be an ester, amide, imide or amine salt and is typically a mixture of two or more of these. When component (A)(II) is an alkali or alkaline-earth metal, the product is the corresponding metal salt.

In one embodiment of the invention, the commercially available material that is useful as a mobility enhancer in accordance with the invention is a material available from the Ferro Corporation under the tradename "DI-43". DI-43 is a fatty acid soap. In another embodiment, the mobility enhancers useful in accordance with this invention are compounds prepared by reacting a fatty acid (component (A)(I)) with a primary or secondary hydroxylamine (A)(II). Materials prepared in this manner generally are referred to in the industry as "alkanolamides". The use of alkanolamides in the composition and process of the present invention not only results in a reduction in the coefficient of static friction when the composition is applied to an aluminum container, the use of such compositions in one or more of the can wash or rinse stages used in the manufacturing of cans following the can formation results in lowering of the drying temperature. That is, when the compositions of the invention are used in aluminum can washing processes, the temperature at which the washed cans can be dried in an oven is lower than the temperature at which aluminum cans can be dried if the alkanolamide is not included in the composition. Alkanolamides as described above and which are useful for improving the mobility and reducing the oven drying temperature of aluminum cans in accordance with the invention include a variety of alkanolamides which are commercially available under various trade designations. Representative examples of specific materials useful as mobility enhancers and for lowering oven-drying temperatures include:

| Trade Name | Manufacturer | Chemical Composition |
|---|---|---|
| DeMide OA-100 M | Deforest Enterprises | 1:1 oleic diethanolamide |
| DeMide CCN-100 | Deforest Enterprises | 1:1 coconut diethanolamine |
| Ethox 2449 | Ethox Chemical | 1:1 alkanolamide based on coconut oil |
| Laurel SD-LOA | Reilly-Whiteman | 2:1 lard oil alkanolamide |
| Laurel SD-101 | Reilly-Whiteman | 2:1 coconut oil alkanolamide |
| Laurel SD-400 | Reilly-Whiteman | 2:1 oleic acid alkanolamide |
| Laurel SD-800 | Reilly-Whiteman | 2:1 adipic acid alkanolamide |
| Laurel SD-1050 | Reilly-Whiteman | 1:1 coconut acid mono-ethanolamide |
| Mazamide JT-128 | PPG | 1:1 coco-diethanolamide |
| Mazamide JR-100 | PPG | 2:1 coconut diethanolamide |
| Mazamide CMEA | PPG | coco-monoethanolamide |
| Monamid LMA | Mona Industries, Inc. | lauric monoethanolamide |
| Monamid 150-IS | Mona Industries, Inc. | 1:1 isostearic diethanolamide |
| Monamid 150-MW | Mona Industries, Inc. | myristic alkanolamide |
| Witcamide M-3 | Witco Corp. | coconut diethanolamide |
| Witcamide 6310 | Witco Corp. | lauric diethanolamide |

Aqueous Composition

The amount of mobility enhancer employed in the inventive aqueous compositions is sufficient such that when the aqueous composition is applied (e.g., spray, immersion, etc.) to at least part of the exterior surface of an aluminum can, the coefficient of static friction (C.O.S.F.) on said exterior surface is reduced to a level that is lower than would be obtained on a can surface of the same type without the application of such composition. Preferably, the C.O.S.F. is reduced to a level of about 0.90 or below, more preferably less than about 0.85, more preferably less than about 0.80. In one embodiment, the concentration of the inventive mobility enhancer in these aqueous compositions is from about 0.025 to about 5 grams/liter, preferably about 0.025 to about 3 grams/liter. The inventive aqueous compositions can have a pH ranging from about 0.5 to about 13, preferably about 0.9 to about 12.4. The inventive mobility enhancer can also be mixed with water to form aqueous concentrates. These concentrates usually contain about 10% to about 90% by weight of the inventive mobility enhancer. In one embodiment, the water employed in such aqueous compositions and/or concentrates is deionized water.

In one embodiment, the inventive aqueous compositions are used in one or more can wash or rinse stages that are used in the manufacturing of cans following the can forming step. These are discussed in greater detail below. In this embodiment the inventive mobility enhancer can be added directly to the wash or rinse treatment composition and the resulting aqueous composition that is formed is the inventive aqueous composition contemplated herein. The inventive mobility enhancer can be initially diluted with water to form a concentrate as discussed above. These concentrates can also include one or more additional chemicals (e.g., acid cleaners, alkaline cleaners, conditioners, conversion coating chemicals, antifoam agents, antimicrobial or biocidal agents, etc.) that are used during one or more of the wash or rinse stages. The concentrate is then diluted with water to form the desired wash or rinse composition.

Any antimicrobial or biocidal agent, except those having some detrimental effect on the mobility enhancing properties or the stability of the inventive aqueous composition, may advantageously be added to the inventive aqueous composition in an amount sufficient to effectively inhibit the growth of microorganisms. Hydrogen peroxide is useful for this purpose. The inventive aqueous compositions can contain up to about 3% by weight hydrogen peroxide.

Any antifoam agent, except those which have some detrimental effect on the mobility enhancing properties already described or the stability of the inventive aqueous composition, may advantageously be added to the inventive aqueous composition in an amount effective to decrease the amount of foaming observed during preparation and/or use of the compositions. A useful antifoam agent is a combination of wax, low volatility liquid paraffin hydrocarbons, and high molecular weight fatty acid derivatives. The inventive aqueous compositions can contain up to about 2% by weight of said antifoam agent, and in some instances up to about 1% by weight.

For purposes of this invention, the C.O.S.F. is determined using an incline plane mobility test which measures the frictional forces that cause the cans to remain stationary. Mobility is related to the C.O.S.F. which is the tangent of the angle of incline necessary to overcome these frictional forces. Reducing the C.O.S.F. enables the cans to move more freely, thus improving their mobility. The procedure for measuring the C.O.S.F. is as follows:

(1) Remove three cans from oven and allow the cans to cool for three minutes. During this time, mark one set of "looper lines" on each can.

(2) Place the cans on the incline plane with the "looper lines" pointing up. The two base cans are placed with the open side to the right. The top can is placed with the open end to the left, approximately one inch from the open end of the bottom cans.

(3) Slowly elevate the platform (incline plane) until the top can slides and strikes the horizontal surface and note the angle of incline. Rotate the top can 90 degrees and repeat the process three more times. Rotate the bottom cans 180 degrees and repeat the cycle once again.

(4) The complete procedure produces eight data points. The data is reported as the tangent of the average of the angle of incline which is expressed as the C.O.S.F.

Aluminum Can Washing

The inventive mobility enhancer is adapted for improving the mobility of aluminum cans as they are conveyed at high speeds along conveyors. The mobility enhancer lowers the C.O.S.F. on the outside surface of the can and thereby enhances its mobility. The process is particularly suitable for enhancing the mobility of cans manufactured in a high speed production line (i.e., in excess of about 1000 cans per minute, preferably in excess of about 1250 cans per minute, more preferably in excess of about 1400 or more cans per minute) as the cans pass from the wash process area of the manufacturing facility to other areas for further processing (e.g., lacquering, painting, etc.).

The can washing process for which the inventive mobility enhancer is suited can be any process adapted for washing aluminum cans. In one embodiment, the cans that are washed are taken from a drawn and ironed (D&I) forming process. These cans generally have oils, aluminum fines and other contaminants adhered to their surface. These contaminants must be removed before the cans can be lacquered, painted, printed, etc. Also, during the wash process chemical conversion coatings can be deposited on the cans to promote adhesion of subsequently applied paints, lacquers and the like, improve mobility, prevent dome discoloration which can occur during the pasteurization of beer, and/or enhance corrosion resistance. A conditioning rinse can be applied to improve cleanliness.

Most aluminum can washing operations employ six sequential wash or rinse stages:

| | |
|---|---|
| Stage 1: | Prewash |
| Stage 2: | Acid or Alkaline Cleaner |
| Stage 3: | Rinse |
| Stage 4: | Condition or Treatment |
| Stage 5: | Rinse |
| Stage 6: | Deionized Water Rinse |

During each stage a bath containing the desired wash or rinse composition is employed. This wash or rinse composition is preferably applied to the cans via spraying although other application techniques such as immersion can be used. Following stage 6, the cans are dried and then conveyed to a work station remote from the washing operation wherein they are further processed (e.g., printed, lacquered, painted, etc.). The inventive mobility enhancer can be used during one or more of stages 2 to 6, and is preferably used in either stage 2 or stage 4. It is preferably mixed with the other ingredients of the wash or rinse and applied to the cans with such other ingredients.

Those skilled in the art will recognize that, in some instances, one or more of the foregoing stages 1–6 can be eliminated, two or more stages can be merged into one, or additional treatment stages can be added. When such modifications are employed, it will be understood that the inventive mobility enhancer can be applied to the surface of the can during any stage from the cleaning stage (i.e., stage 2) to just prior to the drying stage.

The prewash stage (stage 1) is used to remove heavy accumulations of oil and aluminum fines from the can surface before entering the acid or alkaline cleaning stage (stage 2). In one embodiment, the prewash is operated at a temperature in the range of about 60° F. to about 150° F., preferably about 80° F. to about 130° F., more preferably about 110° F. to about 120° F., and a pH that is preferably in the range of about 2 to about 5, more preferably about 2.5 to about 3.5. Typically, the cans are sprayed for about 10 to about 60 seconds, more preferably about 20 to about 40 seconds, more preferably about 30 seconds.

The cleaning stage (stage 2) is used to remove the balance of the organic and inorganic soils remaining on the can surface after the prewash. Either an acidic or an alkaline cleaner can be used in this step. The organic soils include water-soluble lubricants from the cupper and bodymaker operations, rolling oils, and general shop dirt. The inorganics include aluminum fines and natural oxide or corrosion. Aluminum fines are small particles of aluminum which are the result of the aluminum being abraded during the forming operation.

In one embodiment of the invention, an aqueous alkaline cleaner is used during stage 2. These cleaning compositions preferably comprise at least one inorganic base and, optionally, at least one complexing agent. The inorganic base is provided in an amount sufficient to achieve satisfactory removal of aluminum fines from the container surfaces. The complexing agent is provided in an amount sufficient to complex at least some of the metal ions in the operating bath. These ions tend to form undesirable precipitates in the aqueous alkaline medium.

The inorganic base may comprise any one or a combination of bath-soluble compounds including alkali or alkaline earth metal borates, carbonates, hydroxides, phosphates, and mixtures thereof. Alkali metal hydroxides and alkali metal carbonates are preferred materials. A mixture of sodium hydroxide and sodium carbonate can be used. The concentration of the inorganic base is preferably at a sufficient level to remove substantially all of the aluminum fines on the container surfaces while at the same time not unduly etching the aluminum surface so as to provide a clean, bright, reflective appearance. The inorganic base is typically employed at a sufficient concentration to provide an operating pH in the range of about 8 to about 13. Preferably, the pH of the operating cleaning solution is controlled within a range of about 10 to about 13, more preferably about 11.5 to about 12.5, and in one embodiment it is advantageously in the range of about 11.7 to about 12.1. In order to provide the foregoing alkalinity, the inorganic base is typically employed at a concentration of about 0.05 to about 10 g/l with concentrations of about 0.4 to about 3.5 g/l being useful.

The complexing agent may comprise any one or a combination of bath-soluble compounds which are effective to complex at least some of the metal ions present in the operating bath to avoid the formation of deleterious precipitates. For this purpose, sugar acids as well as salts thereof are useful. Included among such complexing agents are gluconic acid, citric acid, glucoheptanoic acid, sodium tripolyphosphate, EDTA, tartaric acid or the like, as well as the bath-soluble and compatible salts thereof and mixtures thereof. Generally, the concentration of the complexing agent in the operating bath is controlled within a range of about 0.01 up to about 5 g/l with concentrations of from about 0.05 to about 1 g/l being useful.

In one embodiment, an aqueous acidic cleaner is used during stage 2. These acidic compositions generally comprise at least one inorganic acid. Examples of such inorganic acids include sulfuric acid, the hydrohalic acids and mixtures thereof. Hydrofluoric acid is a particularly useful hydrohalic. A source of fluoride ions (e.g., ammonium bifluoride) can be used as an alternative to hydrofluoric acid. Mixtures of sulfuric acid and hydrofluoric acid are useful.

In one embodiment, sulfuric acid is employed in the acidic cleaning composition at a sufficient concentration to maintain the pH between about 0.5 and about 6, preferably about 0.5 and 2.5. Concentrations of sulfuric acid of about 0.1 to about 60 grams/liter, preferably from about 1 to about 10 grams/liter can be used. The concentration of sulfuric acid can be at a level of about 4 to about 8 grams/liter.

In one embodiment, hydrofluoric acid is present in the acidic cleaning composition at a concentration of about 0.005 to about 0.7 gram/liter, preferably about 0.005 to about 0.1 gram/liter. The hydrofluoric acid can be present at a concentration of about 0.01 to about 0.03 gram/liter.

The aqueous alkaline and acidic cleaner compositions may contain at least one surfactant. More often, a combination of at least two surfactants are utilized. The surfactants are used to effect an efficient removal of lubricants and organic soils of the types customarily employed in the drawing and forming of aluminum containers. Combinations of nonionic and anionic surfactants are particularly useful.

The nonionic surfactants may be those containing ether linkages and which are represented by the following general formula $$RO(R'O)_nH$$

wherein R is a hydrocarbon group containing from 6 to 30 carbon atoms, R' is an alkylene group containing 2 or 3 carbon atoms or mixtures thereof, and n is an integer of from 2 to 100. Such surfactants are produced generally by treating fatty alcohols or alkyl-substituted phenols with an excess of ethylene oxide or propylene oxide. The alkyl carbon chain may contain from about 14 to 24 carbon atoms and may be derived from a long chain fatty alcohol such as oleo alcohol or stearyl alcohol.

Nonionic polyoxyethylene surfactants of the type represented by the above formula are available commercially under the general trade designations "Surfynol" by Air Products Chemicals, Inc., "Pluronic" or "Tetronic" by BASF Corp., Chemical Division; "Tergitol" by Union Carbide; and "Surfonic" by Texaco Chemicals. Examples of specific polyoxyethylene condensation products useful in the aqueous alkaline cleaner compositions of the present invention include "Surfynol 465" which is a product obtained by reacting about 10 moles of ethylene oxide with one mole of tetramethyldecynediol. "Surfynol 485" is a product obtain by reacting 30 moles of ethylene oxide with tetramethyldecynediol. "Pluronic L35" is a product obtained by reacting 22 moles of ethylene oxide with propylene glycol; "Tergitol TMN 3" is an ethoxylated trimethylnonanol with an HLB of 8.3, and "Tergitol TMN 6" is an ethoxylated trimethylnonanol with an HLB of 11.7. "Surfonic N95" is an ethoxylated nonyl phenol with an HLB of 12.9 and "Pluronic L61" is a block copolymer of propylene oxide and ethylene with an HLB of from 1 to 7.

Another type of nonionic ethoxylated surfactant which is useful in the aqueous alkaline cleaner solutions used in the present invention are block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate compound which is then condensed with ethylene oxide. By varying the proportions of ethylene oxide and propylene oxide used to form the above copolymers, the properties may be varied. Both of the above types of copolymers are available commercially such as from BASF Chemicals under the general trademark "Pluronic". The condensates based on ethylene glycol are identified as the "R" series, and these compounds preferably contain from about 30 to about 80% of polyoxyethylene in the molecule and may be either liquids or solids. The condensates based on propylene glycol are identified generally by BASF as the "F", "L", or "P" series, and these may contain from about 5 to about 80% of ethylene oxide. The "L" series of propylene glycol based copolymers are liquids, the "F" series are solids, and the "P" series are pastes. The solids and pastes can be used when they are soluble in the aqueous cleaner solutions. The molecular weights of these block copolymers range from about 400 to about 14,000.

Anionic surfactants also may be included in the aqueous acidic or alkaline cleaner compositions.

In one embodiment, the anionic surfactants are sulfates or sulfonates. As examples of suitable anionic detergents there may be cited the higher alkyl mononuclear aromatic sulfonates such as the higher alkyl benzene sulfonates containing from 10 to 16 carbon atoms in the alkyl group and a straight or branched chain, e.g., the sodium salts of decyl, undecyl, dodecyl tridecyl, tetradecyl, pentadecyl or hexadecyl benzene sulfonate and the higher alkyl toluene, xylene and phenol sulfonates; alkyl naphthalene sulfonate, and sodium dinonyl naphthalene sulfonate.

Other anionic detergents are the olefin sulfonates, including long chain alkene sulfonates, long chain hydroxyalkane sulfonates or mixtures thereof. These olefin sulfonate detergents may be prepared, in known manner, by the reaction of $SO_3$ with long chain olefins having 8–25, preferably 12–21 carbon atoms. Examples of other sulfate or sulfonate detergents are paraffin sulfonates, such as the reaction products of alpha olefins and bisulfites (e.g., sodium bisulfite). These include primary paraffin sulfonates of about 10–20, preferably about 15–20 carbon atoms; sulfates of higher alcohols; and salts of a-sulfofatty ester (e.g., of about 10 to 20 carbon atoms, such as methyl α-sulfomyristate or α-sulfotallate).

Examples of sulfates of higher alcohols are sodium lauryl sulfate, sodium tallow alcohol sulfate, or sulfates of mono- or diglycerides of fatty aids (e.g., stearic monoglyceride monosulfate), alkyl poly(ethoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly(ethenoxy) ether sulfates such as the sulfates of the condensation products of ethylene oxide and nonyl phenol (usually having 1 to 20 oxyethylene groups per molecule preferably 2–12).

Of the various anionic detergents mentioned, the preferred salts are sodium salts and the higher alkyls are of 10 to 18 carbon atoms, preferably of 12 to 18 carbon atoms. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxyethanol (of 30 ethoxy groups per mole); sodium propylene tetramer benzene sulfonate; sodium hydroxy-n-pentadecyl sulfonate; sodium dodecenyl sulfonate; lauryl polyethoxyethanol sulfate (of 15 ethoxy groups per mole); and potassium methoxy-n-tetradecyl sulfate.

A series of sulfate and sulfonate anionic surfactants are available from the Henkel Corporation under the general trade designation "Sulfotex". For example, Sulfotex LAS-90 is reportedly a sodium dodecyl benzene sulfonate and Sulfotex LCX is a sodium lauryl sulfate.

The anionic surfactant may be of the phosphate mono- or diester type. These esters may be represented by the following formulae:

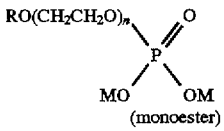

(monoester)

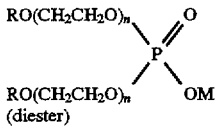

(diester)

wherein R is a fatty chain containing 10 to 18 carbon atoms; each n is independently an integer from 0 to 5; and M is any suitable cation such as alkali metal, ammonium and hydroxyalkyl ammonium.

These types of surfactants are also well known and are commercially available. One series is available from the GAF Corporation under the general trade designation "GAFAC". For example, GAFAC 510 and the G for "R" series are anionic surfactants reported to be free acids of a complex phosphate ester. Sodium and potassium salts of complex phosphate esters also are available under the GAFAC designation.

Anionic surfactants are also available from Rohm & Haas Company under the general trade designation "Triton". For example, Triton H-55 and H-66 are phosphate surfactants (potassium salts); Triton QS-30 and QS-44 are anionic phosphate surfactants in the free acid form; Triton W-30 is a sodium salt of an alkyl aryl polyether sulphate; and Triton DF-20 is a modified ethoxylate.

The amount of surfactant or combination of surfactants included in the aqueous acid and alkaline cleaner compositions is an amount which is effective to remove contaminants from the surface of the container. In one embodiment, this amount is also sufficient to provide a substantially 100% water-break-free surface. A 100% water-break-free surface is achieved when the water "sheets off" leaving a continuous thin layer of water after rinsing. A 100% water-break-free surface represents a surface that is free of lubricants or oils. Typically, the amount of surfactant or combination of surfactants included in the operating or working aqueous acidic or alkaline cleaner will range from about 0.003 to about 5 g/l with concentrations of from about 0.02 to about 1 g/l being useful.

In one embodiment of the invention, the inventive mobility enhancer is applied to the can surface as part of either the aqueous acidic or alkaline cleaning composition. The concentration of the mobility enhancer in such cleaning compositions should be sufficient to provide the can with the desired mobility properties once the can passes through the final rinse stage (stage 6) and is dried. This concentration is preferably in the range of about 0.025 to about 5 g/l, more preferably about 0.025 to about 3 g/l.

The aqueous acidic or alkaline cleaning composition is applied to the can surface at comparatively low to moderate temperatures of generally below about 150° F. to about ambient (i.e., about 60° F.) and preferably within a range of about 90° F. to about 130° F. The contacting of the can may be effected by flooding, immersion, or spraying of which the latter constitutes the preferred technique. In one embodiment, the cans are sprayed for about 10 to about 50 seconds, preferably about 20 to about 30 seconds. The makeup and replenishment of the cleaning composition is preferably performed by employing a concentrate of the several constituents in the appropriate proportions. The concentrate can be provided in the form of a dry particulated product and preferably, in the form of an aqueous concentrate containing from about 50% up to about 90% by weight water with the balance comprising the active ingredients present in the same relative proportions as employed in the final diluted operating bath.

The purpose of the rinse in stage 3 is to completely remove all acidic or alkaline cleaner and soils from the can surface prior to subsequent treatment. In order to conserve water and to obtain the maximum benefit from the amount of water used, a two-stage counterflowed rinse can be used. After the cleaner stage blow-off, some washers use a spray rinse directed on the cans. This rinse can be followed by a blow-off and is commonly called a drag-out rinse. Recirculated water rinse can be used in stage 3. This recirculated rinse can be supplied as fresh water or, in many instances, by counterflowed water from stage 5. Spray pressures are regulated so as to balance input and output to the drag-out rinse with a minimum of overflow of the tank used in stage 3. In one embodiment, tap or city water is used as the rinse water and an effective amount of sulfuric acid is added to provide a pH in the range of about 1.5 to about 3, preferably about 1.9 to about 2.1. The temperature of the rinse can be in the range of about 70° F. to about 150° F., preferably about 90° F. to about 120° F. In one embodiment, the cans are sprayed for about 1 to about 60 seconds, more preferably about 5 to about 20 seconds, more preferably about 15 seconds.

A conversion coating or conditioning rinse can be applied in stage 4. In one embodiment of the invention, the inventive mobility enhancer is applied to the can surface during this stage. The conversion coating, when applied, is used to enhance can transport mobility, protect against exterior dome staining which can occur during the pasteurization of beer, provide corrosion resistance, and promote adhesion of subsequently applied organic coatings such as paints, lacquers, printing inks, and the like. The conversion coating treatment, when applied, is applied to at least part of the exterior surface of the can and may be any one that is conventionally available including, for example, treatment solutions based on chromium (e.g., chromium phosphate) or titanium, zirconium, or hafnium, with or without tannin. Exemplary of such conversion coating solutions and processes are those described in U.S. Pat. Nos. 4,017,334; 4,054,466; and 4,338,140, the teachings of which are incorporated herein by reference.

The conditioning rinse, when applied, is used to promote cleanliness of the can surface. In one embodiment, an aqueous composition containing sulfuric acid, hydrofluoric acid and boric acid is used.

The inventive mobility enhancer, when applied during this stage 4, is applied at a sufficient level to provide the can with the desired mobility properties once the can passes through the final rinse stage (stage 6) and is dried. The concentration of the mobility enhancer in the stage 4 treatment solution is preferably in the range of about 0.025 to about 5 g/l, more preferably about 0.025 to about 3 g/l.

In one embodiment, the stage 4 treatment bath has a pH in the range of about 1 to about 4, preferably about 1.8 to about 3, and a temperature in the range of preferably about 60° F. to about 150° F., more preferably about 90° F. to about 150° F., more preferably about 110° F. to about 130° F. The stage 4 treating solution is preferably sprayed on to the cans for about 1 to about 60 seconds, more preferably about 5 to about 20 seconds, more preferably about 10 seconds.

The purpose of the rinse in stage 5 is to remove all residual conversion coating or conditioning rinse chemicals from the can body prior to the final deionized water rinse of stage 6. To conserve water and to obtain the maximum benefit from the water used, this rinse can be constructed and operated similar to stage 3. In one embodiment, the stage 5 water rinse is operated at ambient temperature and a pH in the range of about 4 to about 5. An inorganic acid, preferably sulfuric acid, is preferably used to achieve the desired pH. In one embodiment, the cans are sprayed for about 1 to about 60 seconds, more preferably about 5 to about 30 seconds, more preferably about 15 seconds.

The last process stage in the can washer is stage 6 which is the deionized water rinse. By deionization, water purity as good as distilled water can be obtained. Deionized water is tap water (city or well water) from which all or most of the natural mineral salts (calcium, silicates, phosphates, etc.) have been removed by means of ion exchange columns. This stage is typically operated at a pH in the range of about 3 to about 5, preferably about 4 to about 4.5. An inorganic acid such as sulfuric acid is used to provide the desired pH. This stage is generally operated at ambient temperature, and in one embodiment the cans are sprayed for about 1 to about 60 seconds, more preferably about 5 to about 20 seconds, more preferably about 10 seconds.

An antifoaming agent of the type discussed above can be used during one or more of stages 2–6 to avoid objectionable foaming. Similarly, an antimicrobial or biocidal agent of the type discussed above can be added to the aqueous compositions used in any of stages 2–6 to inhibit the growth of microorganisms. In one embodiment, the antifoaming agent and/or the antimicrobial or biocidal agent is combined with the inventive mobility enhancer in any of stages 2–6, and preferably in stage 2 or stage 4.

Following the deionized water rinse, the cans are conveyed through a dry off oven to remove all moisture from the cans. The temperature of the dry off should be as low as possible to dry the cans. In one embodiment, temperatures of about 325° F. to about 375° F. are used, and the residence time for each can in the oven is about 20 seconds to about five minutes, preferably about 30 seconds to about two minutes, more preferably about one minute. From the dry off oven the cans are conveyed along a high-speed conveyor (e.g., conveyorized transfer lines, chutes, single filers, etc.) at typical rates in excess of about 1000 cans per minute or higher (e.g., in excess of about 1200 cans per minute, in excess of about 1400 cans per minute, etc.) to another location in the manufacturing facility wherein the cans are printed, lacquered, painted, etc.

An advantage of using the inventive mobility enhancer is that it provides desired mobility enhancement to the cans without interfering with subsequent printing, lacquering and painting operations. It also does not detrimentally affect food and beverage products that are used to fill the cans. In this regard, for example, the inventive mobility enhancer does not detrimentally affect the taste of beer that is used to fill the cans.

The following examples are provided to further describe the invention. Unless otherwise indicated, in the examples and elsewhere in the specification and claims, all parts and percentages are by weight, temperatures are in degrees Fahrenheit, and pressures are at or near atmospheric pressure. If a temperature is not mentioned, it is presumed to be ambient temperature.

EXAMPLE I

This example demonstrates improved mobility performance when DI-43 (a product of Ferro which is identified as a fatty acid soap) is used as a mobility enhancer in stage 4 of a conventional alkaline cleaning process. Aluminum cans from a can manufacturer are cleaned in a spray cabinet using an alkaline cleaner: DR-1369/1370 available from Man-Gill Chemical Company which is a blend of NaOH, KOH, sodium gluconate, nonyl phenol ethoxylate, (Surfonic N-95), block copolymer of E.O./P.O. (Pluronic L-61), phosphate ester anionic surfactant (Triton H-55) and water. The cans are rinsed with a sulfuric acid solution and then treated with the mobility enhancer. During stage 4, a sodium polyacrylate is mixed with the water and the DI-43. With the control, only plain tap water is used during stage 4. After stage 4, the cans are rinsed with tap water followed by a deionized water rinse and dried in an oven. The process involves the following sequential stages:

| | |
|---|---|
| Stage 1: | Prewash - $H_2SO_4$ and water to pH = 2.8, 100° F. |
| Stage 2: | Man-Gill DR-1369/1370 alkaline wash, 120° F. |
| Stage 3: | Acid rinse $H_2SO_4$ pH = 2.8, 100° F. |
| Stage 4: | Mobility enhancer, water conditioner, ambient temperature |
| Stage 5: | Tap $H_2O$ rinse |
| Stage 6: | Deionized $H_2O$ rinse |

Following stage 6, the cans are oven dried, and then the C.O.S.F. is measured using the incline plane test discussed above. The aqueous compositions used during stage 4 and the C.O.S.F. results are indicated below:

| | Control | A | B | C |
|---|---|---|---|---|
| pH | 7.2 | 8.3 | 8.3 | 8.3 |
| DI-43 (g/l) | — | .06 | .12 | .18 |
| Sodium polyacrylate[1] (g/l) | — | .65 | .65 | .65 |
| Average C.O.S.F. | 1.04 | 0.89 | 0.71 | 0.50 |

[1]Good Rite K-7058N

EXAMPLE II

This example demonstrates improved mobility performance when DI-43 is used as a mobility enhancer in stage 4 of a conventional acid cleaning process. Aluminum cans are cleaned using the process steps listed below in a six stage pilot line washer to simulate a typical industrial can washing process. In the control, only plain tap water is used during stage 4. The process involves the following sequential stages:

| | |
|---|---|
| Stage 1: | Prewash $H_2SO_4$ and water to pH = 3.0, 120° F. |
| Stage 2: | PCL-452[1] acid wash, 130° F. |
| Stage 3: | Acid rinse $H_2SO_4$ pH = 2.8, 110° F. |
| Stage 4: | Conditioner, mobility enhancer, ambient temperature |
| Stage 5: | Tap $H_2O$ rinse |
| Stage 6: | Deionized $H_2O$ rinse |

[1]Man-Gill PCL-452/Acc45ss (available from Man-Gill Chemical)

Following stage 6, the cans are oven dried, and then the C.O.S.F. is measured using the incline plane test discussed above. The aqueous compositions used during stage 4 and the C.O.S.F. test results are indicated below:

| | Control | A | B |
|---|---|---|---|
| pH | 7.3 | 8.3 | 8.3 |
| Chelator[1] (g/l) | — | .63 | .63 |
| DI-43 (g/l) | — | 1.06 | 1.27 |
| Polyacrylate[2] (g/l) | — | 1.06 | 1.06 |
| Defoamer[3] (g/l) | — | 0.52 | 0.52 |
| Average C.O.S.F. | 1.04 | 0.89 | 0.50 |

[1]EDTA
[2]Good Rite K-7058N
[3]Foam Ban MS-455

EXAMPLE III

This series of experiments demonstrates the mobility improvement achieved when adding DI-43 as a mobility enhancer to stage 2 of a conventional alkaline cleaning process. The process involves the following sequential steps:

| | |
|---|---|
| Stage 1: | Prewash - $H_2SO_4$ to pH = 3.0, 110° F. |
| Stage 2: | Alkaline cleaner[1]/mobility enhancer, 115 ° F. |
| Stage 3: | Acid Rinse $H_2SO_4$ to pH = 2.8, 100° F. |
| Stage 4: | Tap $H_2O$ rinse |
| Stage 5: | Deionized $H_2O$ rinse |

[1]Man-Gill DR-1369/1370

Following stage 5, the cans are oven dried, and then the C.O.S.F. is measured using the incline plane test discussed above. The concentration of DI-43 used during stage 2 and the C.O.S.F. test results are indicated below:

| | Control | A | B |
|---|---|---|---|
| pH | 12.2 | 12.2 | 12.2 |
| DI-43 (g/l) | — | 0.06 | .125 |
| Average C.O.S.F. | 0.97 | 0.57 | 0.50 |

EXAMPLE IV

A series of tests are performed using DI-43 as a mobility enhancer in stages 2 and 4 with the pH of the composition used in these stages varying from 0.95 to 12.2. The pH of the stages are adjusted using sodium hydroxide or sulfuric acid. Examples A, F, and G are from the data simulating the stage 2 addition of the DI-43 in the acid or alkaline cleaning processes of Examples III or V. In the control, only tap water is used during stage 4. A typical process involves the sequential stages listed below.

| | |
|---|---|
| Stage 1: | Prewash $H_2SO_4$ to pH = 3.0, 100° F. |
| Stage 2: | Alkaline cleaner[1], 115° F. |
| Stage 3: | Acid rinse $H_2SO_4$ to pH = 2.8, 100° F. |
| Stage 4: | Mobility enhancer/water conditioner |
| Stage 5: | Tap $H_2O$ rinse |
| Stage 6: | Deionized $H_2O$ rinse |

[1]Man-Gill DR-1369/1370

Following stage 6, the cans are oven dried, and then the C.O.S.F. is measured using the incline plane test discussed above. The results are as follows:

| | Control | A | B | C | D | E | F | G |
|---|---|---|---|---|---|---|---|---|
| pH (Stage 4) or (stage 2) | 7.3 | 12.2 | 10 | 8.5 | 6.7 | 5.0 | 1.4 | 0.95 |
| DI-43 (g/l) | 0.0 | 0.18 | 0.75 | 0.38 | 0.38 | 0.38 | 0.18 | 0.18 |
| Average C.O.S.F. | 0.97 | 0.50* | 0.54 | 0.75 | 0.69 | 0.68 | 0.58** | 0.69** |

*Data from Example III
**Data from Example V

Note, Examples B, C, E, D contained 1 g/l of polyacrylic acid as water conditioner.

EXAMPLE V

This example demonstrates the mobility improvement achieved when adding DI-43 to an acid cleaner in stage 2. Aluminum cans are cleaned with an acid cleaner available from Man-Gill Chemical Company (PCL-452/Acc45ss which is a blend of sulfuric acid, alkyl polyether (Trycol 6720), ethoxylated rosin (Chemax 497B), hydrofluoric acid, and water). The DI-43 is added to the cleaner. The control acid cleaner does not contain DI-43. The cans are rinsed using an acidic rinse, followed by a tap water rinse, then a deionized water rinse. After the deionized water rinse, the cans are oven dried. The results are as follows:

| | Control | A | B | C | D |
|---|---|---|---|---|---|
| pH | 1.4 | 1.4 | 1.4 | 1.4 | 0.95 |
| DI-43 (g/l) | — | 0.19 | 0.5 | 0.75 | 0.75 |
| Average C.O.S.F. | 0.96 | 0.91 | 0.65 | 0.58 | 0.69 |

EXAMPLE VI

This example demonstrates mobility enhancement using DI-43 and deionized water in stage 4 of an alkaline cleaning process. Aluminum cans from a can manufacturer are cleaned in a spray cabinet using Man-Gill DR-1369/1370 alkaline cleaner. The cans are rinsed in a sulfuric acid solution and then treated with the DI-43/deionized water composition. In the control only deionized water is used in stage 4. After stage 4 the cans are rinsed with tap water followed by a deionized water rinse and dried in an oven. The test procedure involves the following sequential stages:

| |
|---|
| Stage 1: Prewash $H_2SO_4$ pH = 3.0, 100° F. |
| Stage 2: Alkaline cleaner, 115° F. |
| Stage 3: Acid rinse $H_2SO_4$ pH = 2.8, 110° F. |
| Stage 4: Mobility enhancer using deionized water, ambient temperature |
| Stage 5: Tap $H_2O$ rinse |
| Stage 6: Deionized $H_2O$ rinse, pH adjusted with $H_2SO_4$ |

Following stage 6, the cans are oven dried, and then the C.O.S.F. is measured using the incline plane test discussed above. The results are as follows:

| | Control | A | B | C |
|---|---|---|---|---|
| DI-43 (g/l) | — | 0.06 | 0.06 | 0.06 |
| pH | — | 5.2 | 3.9 | 9.2 |
| Average C.O.S.F. | 0.86 | 0.62 | 0.58 | 0.57 |

EXAMPLE VII

This example illustrates the mobility enhancement and drying temperature reduction obtained using Monamid M-150-IS as the mobility enhancer in stage 4 of an alkaline cleaning process. Aluminum cans from a can manufacturer are cleaned in a spray cabinet using Man-Gill DR-1369/1370 alkaline cleaner. The cans are rinsed in a sulfuric acid solution and then treated with the Monamid/water composition in stage 4. In the control, only water is used in stage 4. After stage 4, the cans are rinsed with tap water followed by a deionized water rinse and dried in an oven. The test procedure involves the following sequential stages.

| | |
|---|---|
| Stage 1: | Prewash - sulfur $H_2SO_4$ and water, pH = 2.8, 100° F. |
| Stage 2: | Alkaline cleaner, 120° F. |
| Stage 3: | Acid rinse - $H_2SO_4$ and water, pH = 2.8, 100° F. |
| Stage 4: | Monamid 150-IS and water, ambient temperature |
| Stage 5: | Tap water rinse, ambient temperature |
| Stage 6: | Deionized water rinse, ambient temperature |

Following stage 6, the cans are dried in an oven maintained at the various temperatures indicated in the following table. The coefficient of static friction is measured via the incline plane test procedure discussed above, the and percent of the cans which remain wet after a residence time in the oven of about 2 minutes is recorded. The results are as shown in the following table.

| M-150-IS ppm | Oven Temp./°F. | C.O.S.F. | Wet Cans/% |
|---|---|---|---|
| 0 (Control) | 400 | 1.41 | 25 |
| 250 | 400 | 1.13 | 0 |
| 250 | 375 | 1.15 | 0 |
| 250 | 350 | 1.1 | 0 |
| 250 | 330 | 0.74 | 0 |
| 250 | 300 | 0.69 | 25 |
| 375 | 300 | 0.69 | 33 |
| 500 | 300 | 0.61 | 17 |
| 500 | 305 | 0.65 | 33 |
| 500 | 315 | 0.63 | 0 |
| 0 (Control) | 315 | 1.14 | 83 |

EXAMPLE VIII

The general washing procedure of Example VII is repeated on aluminum cans except that the aqueous solution used in stage 4 contains 500 ppm (except the control examples which contain 0 ppm) of the alkanolamides identified in the following table. The oven temperature is varied as indicated in the table to demonstrate the effect of the mobility enhancers in reducing drying temperature. Following oven drying (about 2 minutes), the coefficient of static friction is measured via the incline plane mobility test procedure described above, and the percent of the cans which remain wet when removed from the oven is determined. The results are summarized in the following table.

| Alkanolamide | Oven Temp./°F. | C.O.S.F. | Wet Cans/% |
|---|---|---|---|
| None | 425 | 1.33 | 0 |
| None | 400 | 1.29 | 86 |
| DeMide OA-100 M | 400 | 0.99 | 0 |
| DeMide OA-100 M | 380 | 0.63 | 0 |
| DeMide OA-100 M | 370 | 1.15 | 29 |
| DeMide OA-100 M | 325 | 1.15 | 100 |
| DeMide CCN-100 | 390 | 1.11 | 0 |
| DeMide CCN-100 | 380 | 1.13 | 14 |
| Mazamide JR-100 | 390 | 1.11 | 0 |
| Monamid 150-IS | 315 | 0.63 | 0 |
| Monamid 150-IS | 305 | 0.66 | 33 |
| Monamid 150-IS | 300 | 0.61 | 17 |

The process of the present invention is applicable to cans made of pure aluminum, or alloys of aluminum which may contain minor amounts of metals such as magnesium, manganese, copper and silicon. These include three common alloys used in the container industry which are identified as aluminum alloys 3003, 3004 and 5182.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for conveying an aluminum can along a conveyor or trackwork comprising:

applying an effective amount of at least one mobility enhancer to the surface of said can to enhance the mobility of said can by decreasing the coefficient of static friction on an outside surface of said can to about 0.9 or less and providing a substantially 100% water-break-free surface, said mobility enhancer comprising water, a surfactant and the product made by the reaction of at least one carboxylic acid or acid-producing compound with ammonia, at least one amine, or at least one alkali or alkaline-earth metal; and conveying said can along said conveyor or trackwork.

2. A process for washing an aluminum can, said process comprising the steps of:

prewashing said can;

decreasing the coefficient of static friction on an outside surface of said can to about 0.9 or less and providing a substantially 100% water-break-free surface by washing said can using an acidic or alkaline aqueous composition, said composition comprising a mobility enhancing amount of the product made by the reaction of at least one carboxylic acid or acid-producing compound with ammonia, at least one amine, or at least one alkali or alkaline-earth metal, and a surfactant;

rinsing said can using an aqueous acidic composition;

rinsing said can using deionized water;

drying said can; and conveying said can along a conveyor or trackwork.

3. A process for washing an aluminum can, said process comprising the steps of:

prewashing said can;

decreasing the coefficient of static friction on an outside surface of said can to about 0.9 or less and providing a substantially 100% water-break-free surface by washing said can using an acidic or alkaline aqueous composition, said composition comprising a mobility enhancing amount of the product made by the reaction of at least one carboxylic acid or acid-producing compound with ammonia, at least one amine, or at least one alkali or alkaline-earth metal, and a surfactant;

rinsing said can;

applying at least one surface conditioner and/or conversion coating to at least part of the exterior surface of said can;

rinsing said can;

drying said can; and conveying said can along a conveyor or trackwork.

4. A process for washing an aluminum can, said process comprising the steps of:

washing said can using an acidic or alkaline aqueous composition;

rinsing said can;

decreasing the coefficient of static friction on an outside surface of said can to about 0.9 or less and providing a substantially 100% water-break-free surface by applying at least one aqueous mobility enhancing composition to the exterior surface of said can, said mobility enhancing composition comprising water, a surfactant and a mobility enhancing amount of the product made by the reaction of at least one carboxylic acid or acid-producing compound with ammonia, at least one amine, or at least one alkali or alkaline-earth metal;

drying said can; and conveying said can along a conveyor or trackwork.

5. A process for washing an aluminum can, said process comprising the steps of:

prewashing said can using an aqueous acidic composition;

washing said can using an acidic or alkaline aqueous composition;

rinsing said can using an aqueous acidic composition;

decreasing the coefficient of static friction on an outside surface of said can to about 0.9 or less and providing a substantially 100% water-break-free surface by applying an aqueous mobility enhancing composition to the exterior surface of said can, said mobility enhancing composition comprising water, a surfactant and a mobility enhancing amount of the product made by the reaction of at least one carboxylic acid or acid-producing compound with ammonia, at least one amine, or at least one alkali or alkaline-earth metal;

rinsing said can using an aqueous acidic composition;

rinsing said can using deionized water;

drying said can; and conveying said can along a conveyor or trackwork.

6. A process of decreasing the coefficient of static friction and providing a substantially 100% water-break-free surface on an outside surface of an aluminum can to about 0.9 or less by washing the aluminum can and decreasing the drying temperature of the washed can which comprises applying to the can before drying, an aqueous composition comprising water, from about 0.003 to about 5 q/l of a surfactant and from about 0.05 to about 3 g/l of an alkanolamide prepared by reacting (A)(1) an aliphatic carboxylic acid containing from about 12 to about 22 carbon atoms with a primary or secondary hydroxylamine.

7. The process of claim 6 wherein the aliphatic carboxylic acid is a fatty acid.

8. The process of claim 6 wherein the hydroxylamine is a mono- or di-hydroxymethyl or hydroxyethylamine.

9. The process of claim 6 wherein the aqueous solution is applied to the can after the can has been washed with an alkaline and/or acid cleaner solution.

10. The process of claim 6 wherein the aliphatic monocarboxylic acid (A)(1) is an aliphatic monocarboxylic acid.

11. The process of claim 6 wherein the aqueous composition also contains at least one inorganic base in an amount sufficient to provide a pH of from about 0.5 to about 6 or a base in an amount sufficient to provide a pH of from about 8 to about 13.

12. A process for washing an aluminum can, said process comprising the steps of:

decreasing the coefficient of static friction on an outside surface of said can to about 0.9 or less and providing a substantially 100% water-break-free surface by washing said can using an acidic or alkaline aqueous composition, said composition comprising a mobility enhancing amount of the product made by the reaction of at least one carboxylic acid or acid-producing compound with ammonia, at least one amine, or at least one alkali or alkaline-earth metal, and a surfactant;

rinsing said can;

drying said can; and conveying said can along a conveyor or track work.

13. The process of claim 12 wherein the product contained in the acidic alkaline aqueous composition is made by reacting an aliphatic monocarboxylic acid containing from about 12 to about 22 carbon atoms with a primary or secondary hydroxylamine.

14. The process of claim 12 wherein the aqueous composition also contains an effective amount of at least one antimicrobial or biocidal agent to inhibit the growth of microorganisms.

15. The process of claim 12 wherein the aqueous composition comprises from about 0.025 to about 5 grams per liter of the product made by the reaction of at least one carboxylic acid or acid-producing compound with ammonia, at least one amine, or at least one alkali or alkaline earth metal.

16. The process of claim 12 wherein the carboxylic acid or acid-producing compound is an aliphatic monocarboxylic acid or mono-acid-producing compound.

17. The process of claim 16 wherein the acid or acid-producing compound is selected from the group consisting of anhydrides, acid halides and esters of aliphatic monocarboxylic acids.

* * * * *